US009181729B2

(12) United States Patent
Yamakage et al.

(10) Patent No.: US 9,181,729 B2
(45) Date of Patent: Nov. 10, 2015

(54) LOCK KIT AND KEY ROTOR HOUSED IN ROTOR CASE

(75) Inventors: Sadao Yamakage, Nagoya (JP); Keiichi Araki, Nagoya (JP)

(73) Assignees: SANKYO KINZOKU CO., LTD., Nagoya-Shi, Aichi (JP); TOMOE SYSTEM INC., Kobe-Shi, Hyogo (JP)

( * ) Notice: Subject to any disclaimer, the term of this patent is extended or adjusted under 35 U.S.C. 154(b) by 0 days.

(21) Appl. No.: 13/807,997

(22) PCT Filed: Aug. 9, 2011

(86) PCT No.: PCT/JP2011/068158

§ 371 (c)(1),
(2), (4) Date: Mar. 1, 2013

(87) PCT Pub. No.: WO2012/032893

PCT Pub. Date: Mar. 15, 2012

(65) Prior Publication Data

US 2013/0145804 A1 Jun. 13, 2013

(30) Foreign Application Priority Data

Sep. 7, 2010 (JP) ..... 2010-199805

(51) Int. Cl.
*E05B 29/04* (2006.01)
*E05B 19/06* (2006.01)
(Continued)

(52) U.S. Cl.
CPC ..... *E05B 29/0033* (2013.01); *E05B 19/0017* (2013.01); *E05B 29/00* (2013.01); *E05B 17/181* (2013.01); *E05B 19/0041* (2013.01); *Y10T 70/7599* (2015.04)

(58) Field of Classification Search
CPC ..... E05B 27/0082; E05B 27/0078; E05B 19/0023; E05B 19/0035; E05B 27/0042; E05B 29/00; E05B 29/004; E05B 27/005; E05B 21/063; E05B 19/0017; E05B 19/0052; E05B 19/0058; E05B 19/0064; E05B 29/0033; E05B 29/0093; E05B 19/0041; E05B 17/181
USPC ..... 70/409, 492–495, 337–343, 358, 376, 70/377, 392, 419, 421
See application file for complete search history.

(56) References Cited

U.S. PATENT DOCUMENTS 1,960,263 A * 5/1934 Fitz Gerald ..... 70/492
3,303,677 A * 2/1967 Bauer ..... 70/358
(Continued)

FOREIGN PATENT DOCUMENTS

CN 88100779 8/1988
CN 101033665 9/2007
(Continued)

OTHER PUBLICATIONS

International Search Report for PCT/JP2011/068158 mailed Nov. 15, 2011 (English).
(Continued)

*Primary Examiner* — Lloyd Gall
(74) *Attorney, Agent, or Firm* — Smith, Gambrell & Russell, LLP

(57) ABSTRACT

A lock device (10) is used with a flat key (K) having asymmetric opposite edges (3, 4). The lock device (10) includes a key rotor (14) which is configured to have distances from a central axis line (O2) of the key (K) to abutment points of the edges (3, 4) against the tumbler (32*a*-32*c*) respectively, and the distances are set so as to equal each other such that the non-reversible key is capable of reversible use in an inserted state of the key (K) into a key insertion hole (23).

9 Claims, 5 Drawing Sheets

(51) Int. Cl.

| | |
|---|---|
| ***E05B 29/00*** | (2006.01) |
| *E05B 19/00* | (2006.01) |
| *E05B 17/18* | (2006.01) |

(56) References Cited

U.S. PATENT DOCUMENTS

| | | | | |
|---|---|---|---|---|
| 3,393,542 | A * | 7/1968 | Crepinsek | 70/358 |
| 3,597,948 | A * | 8/1971 | Johnstone | 70/495 |
| 3,707,863 | A * | 1/1973 | Schwab et al. | 70/492 |
| 3,861,181 | A * | 1/1975 | Needham et al. | 70/492 |
| 3,969,915 | A * | 7/1976 | Droske | 70/492 |
| 4,612,787 | A * | 9/1986 | Prunbauer et al. | 70/358 |
| 4,939,915 | A | 7/1990 | Vonlanthen | |
| 5,265,455 | A * | 11/1993 | Grimmer | 70/492 |
| 5,485,735 | A * | 1/1996 | Laabs et al. | 70/358 |
| 5,775,146 | A * | 7/1998 | Edwards et al. | 70/369 |
| 6,101,855 | A * | 8/2000 | Dimig et al. | 70/406 |
| 6,109,081 | A * | 8/2000 | Dimig et al. | 70/492 |
| 6,427,506 | B1 * | 8/2002 | Prunbauer | 70/495 |
| 6,912,881 | B2 * | 7/2005 | Kleinhaeni | 70/409 |
| 7,240,525 | B2 * | 7/2007 | Sevillano Gil | 70/340 |
| 7,424,815 | B1 * | 9/2008 | Pagnoncelli | 70/340 |
| 8,261,588 | B2 * | 9/2012 | Milan | 70/492 |
| 8,276,419 | B2 * | 10/2012 | Farrenkothen et al. | 70/492 |
| 2004/0000178 | A1 * | 1/2004 | Tseng | 70/358 |
| 2006/0201216 | A1 * | 9/2006 | Gil | 70/492 |
| 2007/0209412 | A1 | 9/2007 | Shiramizu et al. | |
| 2008/0047310 | A1 * | 2/2008 | Yu | 70/337 |

FOREIGN PATENT DOCUMENTS

| | | | |
|---|---|---|---|
| GB | 2026587 | A * | 2/1980 |
| JP | 59-203166 | | 11/1984 |
| JP | S59-203166 | | 11/1984 |
| JP | 7-279504 | | 10/1995 |
| JP | 2004-124410 | | 4/2004 |

OTHER PUBLICATIONS

Chinese Office Action for family member CN Application No. 201180033006.3 and English translation thereof.

* cited by examiner

LOCK KIT AND KEY ROTOR HOUSED IN ROTOR CASE

TECHNICAL FIELD

The present invention relates to a lock device for use with a non-reversible key including two flat-plate-shaped edges having asymmetric profiles.

BACKGROUND ART

A lock device has conventionally been provided on door panels together with a door lock mechanism in vehicles such as automobiles, for example. The same lock devices have also been provided in a steering column, a fuel filler opening and the like of the vehicles. A single key is co-used for these lock devices in the vehicles as well known in the art.

Differing from reversible keys, the key of the above-described type sometimes has opposite edges of a key body or shank formed into asymmetric shapes as described above. When locking and unlocking are carried out with the asymmetric key, a user needs to insert the key into a key-insertion hole of the lock device with a correct orientation. More specifically, when the key is inserted with an incorrect orientation and forced to be turned in a half inserted state, there is a possibility that the key may be deformed or broken, or the rotor side of the lock device may be broken, for example. (See Patent Document 1 regarding the reversible keys and asymmetric keys.)

PRIOR ART DOCUMENT

Patent Document

Patent Document 1: JP-A-H07-279504

SUMMARY OF THE INVENTION

Problem to be Overcome by the Invention

However, in introducing the above-described non-reversible key, the hitherto used key cannot naturally be used and accordingly, all the lock devices of the vehicle need to be replaced by new ones adapted to the new key. This results in a problem of high replacement costs.

The present invention was made in view of the foregoing problem and an object thereof is to provide a lock device which can prevent deformation and breakage of the key and/or a key rotor without replacement of the key and which can reduce the replacement costs of the key device as low as possible.

Means for Overcoming the Problem

To achieve the above-described object, the present invention provides a lock device which is used with a plate-shaped non-reversible key including two edges having respective asymmetric profiles, the lock device being usable with a rotor case defining a key rotor and having a tumbler engagement groove formed in a surface thereof facing the key rotor housing, the lock device comprising a key rotor rotatably mounted in the key rotor housing and having an axially extending key insertion hole and a radially extending tumbler disposition groove; and a tumbler movably disposed in the tumbler disposition groove and biased toward a radially peripheral side with respect to the key rotor by a biasing member so that an outer periphery of the tumbler is moved from the tumbler disposition groove to the tumbler engagement groove side to engage the tumbler engagement groove, thereby blocking the key rotor from rotative movement, the key being removably insertable into the key insertion hole so that either edge abuts against the tumbler in an inserted state of the key to move the tumbler into the tumbler disposition groove, whereby the key rotor is allowed to be rotatively moved, wherein the key rotor is configured to have distances from a central axis of the key to abutment portions of the edges against the tumbler respectively, the distances being set so as to equal each other even when the key is inserted into the key insertion hole while assuming either normal or reverse orientation, whereupon the non-reversible key is capable of reversible use.

Effect of the Invention

According to the above-described construction, even when the non-reversible key is inserted with the normal or reverse orientation, the distances from the central axis of the key to abutment portions of the tabular edges against the tumbler respectively are set so as to be equal to each other. Consequently, although the key is of a non-reversible type, the key has no limitation in the orientation of the key to be inserted into the key insertion hole. When the key is inserted into the key insertion hole, either edge can move the tumblers into the respective tumbler disposition grooves. Consequently, application of the above-described lock device can overcome the problem that the key in a wrong orientation is inserted into the key insertion hole, whereupon the key and/or the key rotor can be prevented from deformation.

Since the lock device according to the invention is configured to be used with a non-reversible key, a hitherto used key can be used with the lock device in a reversible manner without replacement. Accordingly, even when the key is co-used between or among a plurality of lock devices, only a desirable one of the lock devices needs to be replaced by the lock device according to the invention, and thus, not all the lock devices need to be replaced. This can reduce the replacement costs to minimum.

EXPLANATION OF SYMBOLS

Figure 1:
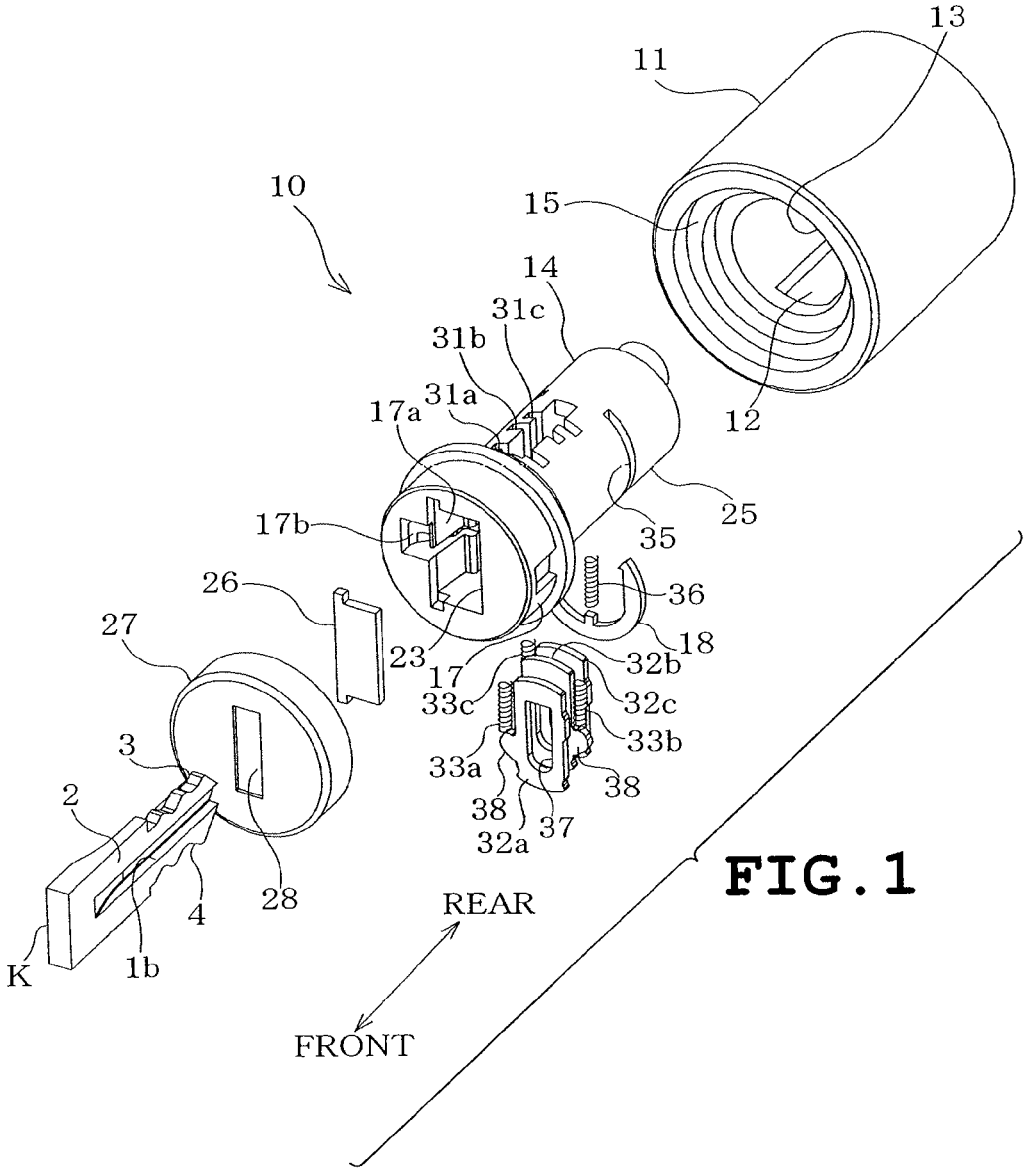
FIG. 1 is an exploded perspective view of the lock device of one embodiment in accordance with the present invention together with a key.

In the drawings, reference symbols 1*a* and 1*b* designate grooves, 3 and 4 edges, 10 a lock device, 11 a rotor case, 23 a key insertion hole, 30*a* and 30*b* guides, 31*a* to 31*c* tumbler disposition grooves, 32*a* to 32*c* tumblers, 33*a* to 33*c* biasing members, K a key, O2 a central axis, Pa to Pc and Pa' to Pc' abutment portions, La to Lc and La' to Lc' distances and P1 and P2 pitches.

BEST MODE FOR CARRYING OUT THE INVENTION

An embodiment will be described with reference to FIGS. 1 to 5B. In the embodiment, the invention is applied to a vehicle such as an automobile. The side where an operator is located in front of a lock device 10 is referred to as "front" and the side opposite the front is referred to as "rear" throughout the description.

The lock device 10 includes a rotor case 11 incorporated into a lock body lateral to a steering column of a vehicle, for example although the lock body and the steering column are not shown. The rotor case 11 is formed into a generally cylindrical shape and has an inner peripheral wall defining an interior serving as a key rotor housing 13. The inner peripheral wall has two axially extending tumbler engagement grooves 12 formed at an interval of 180° so as to be opposed to each other.

The key rotor housing 13 is formed with a front step 15 and a rear step 16 (see FIG. 2) both locking a key rotor 14 and the like in a front-back direction, whereby the key rotor housing 13 is stepped. In more detail, the front step 15 is located in a front part of the key rotor housing 13 to lock a flange 17 of the key rotor 14 when the key rotor 14 is accommodated in the key rotor housing 13. The rear step 16 is located in a rear part of the key rotor housing 13 to lock a stopper ring 18 when the key rotor 14 is accommodated in the key rotor housing 13.

A locking mechanism is disposed in the rear of the rotor case 11 although not shown. The locking mechanism is adapted to be connected to a rear end (a connection 20) of the key rotor 14. The lock device 10 is incorporated in the lock body so as to be connected to the locking mechanism. The lock device 10 turns on and off an ignition switch (not shown) to start and stop an engine and for other purposes.

The key rotor 14 is rotatably mounted in the key rotor housing 13 and has a key insertion hole 23 defined by an inner peripheral wall thereof. The key rotor 14 is made of a metal material and includes a generally columnar rotor body 25, a flange 17 formed on a front end of the rotor body 25 and the connection 20 formed on a rear end of the rotor body 25 all of which are formed integrally with the key rotor 14.

The rotor body 25 has an outer peripheral surface which is formed so as to be brought into sliding contact with an inner peripheral surface of the rotor case 11. The rotor body 25 is inserted from a front thereof into the rotor case 11. The connection 20 includes a pair of upper and lower protrusions 21 and 22 protruding rearward from the rear end of the rotor body 25.

The flange 17 is formed so as to cover the front surface of the key rotor housing 13 and has a front end to which a cap 27 is attached from the front with a generally rectangular plate-shaped shutter 26 being disposed on the front end of the flange 17. In more detail, the cap 27 is formed with a key insertion opening 28 communicating with the key insertion hole 23. The flange 17 has a shutter accommodation recess 17*a* and a spring accommodation recess 17*b* both formed in the front thereof so as to be recessed rearward. The shutter 26 is pivotally mounted on the front of the flange 17 so as to open and close the shutter accommodation recess 17*a*. The shutter 26 is biased by a torsion coil spring (not shown) in a direction such that the shutter 26 closes the key insertion opening 28. The shutter 26 is configured to allow the key K to be inserted through the key insertion opening 28 when opening the insertion opening 28. The torsion coil spring is accommodated in the spring accommodation recess 17*b*.

Figure 2:
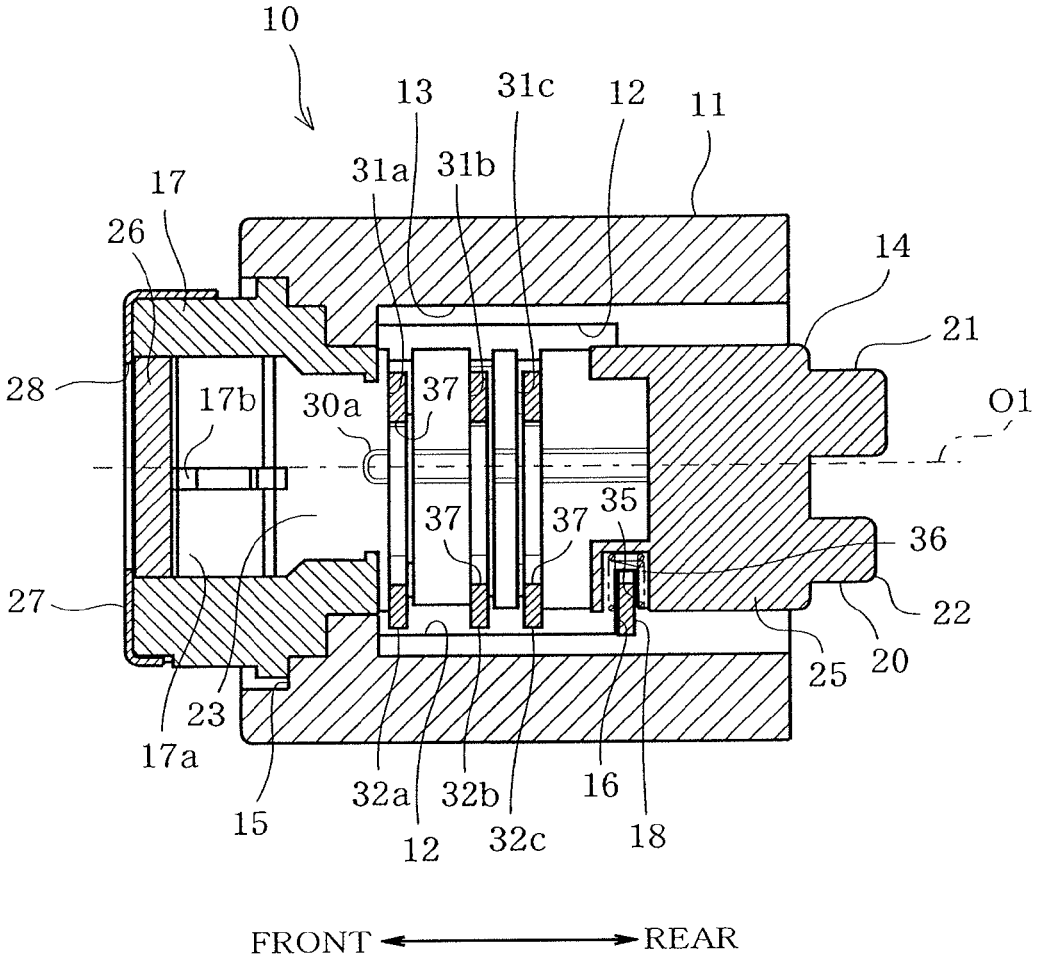
FIG. 2 is a longitudinal side section of a key rotor accommodated in a rotor case.
Figure 3A:
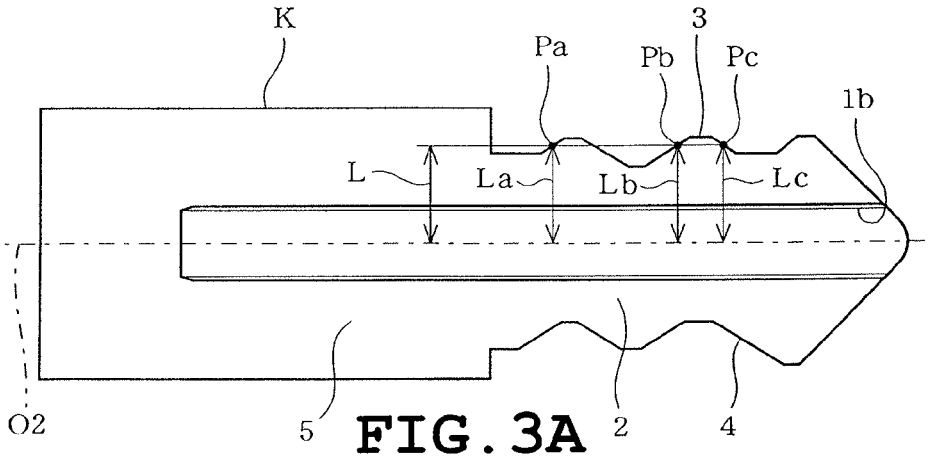
FIG. 3A is a plan view of the key.
Figure 3B:
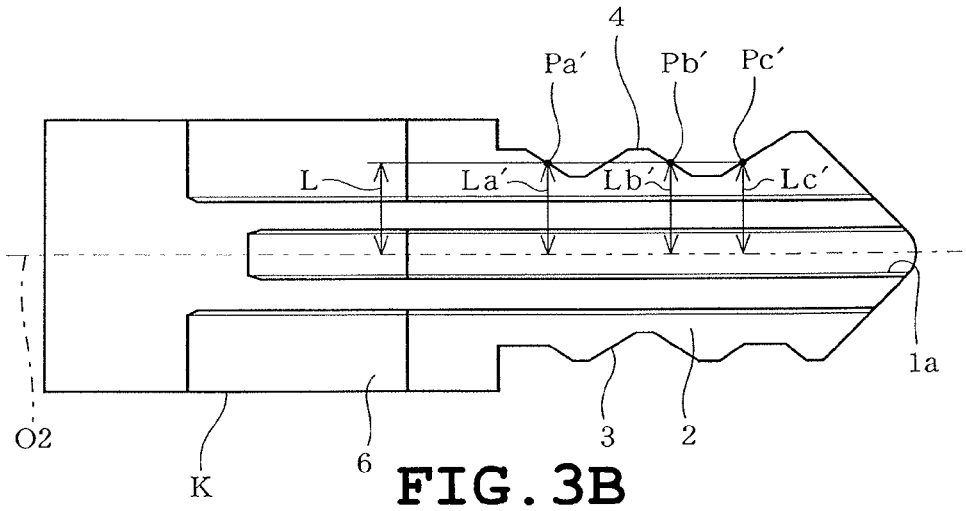
FIG. 3B is a rear view of the key.
Figure 3C:
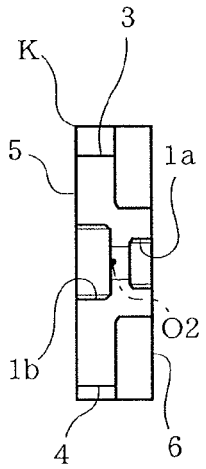
FIG. 3C is a view of the key as viewed from the direction of a central axis.

The key insertion hole 23 extends axially with respect to the key rotor 14 (in the direction of the central axis O1 (see FIG. 2) about which the key rotor 14 directed in the front-back direction pivots). The key insertion hole 23 is formed into a vertically long generally rectangular shape as viewed in a front view. The inner peripheral wall defining the key insertion hole 23 is formed with a pair of inwardly protruding guides 30*a* and 30*b* each extending along the central axis O1 (see FIGS. 2 and 4A). The guides 30*a* and 30*b* are formed into the same shape and are located on the inner peripheral wall of the key rotor 14 defining the key insertion hole 23 so as to be symmetric with respect to the central axis O1 (bilaterally symmetric in the embodiment). Furthermore, the guide 30*a* is sized so as to be fitted in the groove 1*a* and the guide 30*b* is sized so as to be loosely fitted in the groove 1*b* when the key K has been inserted into the key insertion hole 23, as shown in FIGS. 3A to 3C. The key K will be described in detail later.

The rotor body 25 has a plurality of, for example, three tumbler disposition grooves 31*a* to 31*c* which are formed so as to radially extend therethrough and so as to be axially lined with respect to the rotor body 25. Each of the grooves 31*a* to 31*c* is formed into a rectangular shape as axially viewed (from above in FIG. 1, for example) and communicates with the key insertion hole 23. The grooves 31*a* to 31*c* are provided with tumblers 32*a* to 32*c* which are movably disposed, respectively. Counterbores for spring members 33*a* to 33*c* as shown in FIG. 1 are formed so as to correspond to the tumbler disposition grooves 31*a* to 31*c* respectively although not shown in the drawings. The tumblers 32*a* to 32*c* are biased radially outward from the tumbler disposition grooves 31*a* to 31*c* by the spring members 33*a* to 33*c* serving as biasing members respectively. As shown in FIG. 2, the tumblers 32*a* to 32*c* have outer peripheries which are located out of the tumbler disposition grooves 31*a* to 31*c* to the tumbler engagement groove 12 side thereby to engage the tumbler engagement groove 12, whereby the key rotor 14 is prevented from rotative movement.

The rotor body 25 has a stopper disposition groove 35 located in the rear of the tumbler disposition grooves 31*a* to 31*c*. The generally C-shaped stopper ring 18 is movably disposed in the groove 35. The stopper ring 18 is biased radially outward by a spring member 36 disposed on a lower end of the groove 35. When the stopper ring 18 projecting from the groove 35 is engaged with the rear step 16 of the key rotor housing 13, the key rotor 14 is locked so as to be immovable forward.

FIGS. 3A to 3C exemplify the key K of the lock device 10 of the embodiment. The key K as shown in FIGS. 3A to 3C has a central axis O2 that is a lengthwise center line corresponding to the central axis O1 of the key rotor 14 in the case where the key K has been inserted in the key insertion hole 23.

The key K includes an insertion portion or a shank 2 serving as a plate-shaped key body and a head (not shown) located at an end of the shank 2 (the left side as viewed in FIGS. 3A and 3B). The shank 2 has opposite edges 3 and 4 formed with respective profiles of notches or cuts. The edges 3 and 4 are asymmetric about the central axis O2. Each of the edges 3 and 4 is widthwise (that is, in the direction perpendicular to the central axis O2) concave and convex into a stepped shape, as shown in FIGS. 3A and 3B. Furthermore, each of the edges 3 and 4 has no steps in the direction of thickness of the key K (that is, in the direction perpendicular to the plane of FIGS. 3A and 3B) to be substantially even and relatively simple.

The shank 2 of the key K has both sides 5 and 6 with respect to the direction of thickness thereof. The sides 5 and 6 have respective grooves 1*a* and 1*b* which extend lengthwise along the central axis O2 and occupy plane-symmetric positions. The grooves 1*a* and 1*b* are formed in widthwise central portions of the shank 2, for example. The groove 1*a* has a smaller width than the other groove 1*b* and is guided by either guide 30*a* or 30*b*. The key K has been used with another lock device (hereinafter, "conventional lock device") differing from the lock device 10 as will be described in more detail later. Each of the edges 3 and 4 is convex and concave so that the heights of each edge's portions corresponding to tumblers of the conventional lock device differ from one another. In other words, differing from a reversible key, the key K is of a non-reversible type that has a restriction of the orientation with which the key is inserted into a key insertion hole in the conventional lock device.

The lock device 10 of the embodiment is capable of rendering the asymmetric key K usable as a reversible key. Concrete constructions of the key rotor 14 and the tumblers 32*a* to 32*c* for conversion into the reversible key will now be described with reference to FIGS. 4A to 5B as well as with FIGS. 1 to 3. A first orientation refers to a state (see FIG. 4A) in which the key K is inserted with a side 5 thereof constituting a right side and the edge 3 abuts against the tumblers 32*a* to 32*c* in the inserted state of the key K. Furthermore, a second orientation refers to a state (see FIG. 5A) in which the key K is inserted with the other side 6 thereof constituting a right side and the edge 4 abuts against the tumblers 32*a* to 32*c* in the inserted state of the key K.

Firstly, the tumblers 32*a* to 32*c* are, for example, thin-plate shaped tumblers and have the same dimensions as shown in FIG. 1. The tumblers 32*a* to 32*c* have holes 37 through which the key K is inserted and protrusions 38 which engage corresponding spring members 33*a* to 33*c*, respectively. The tumblers 32*a* to 32*c* are disposed so that the protrusions 38 (or the spring members 33*a* to 33*c*) of the adjacent tumblers are located opposite each other.

Figure 4A:
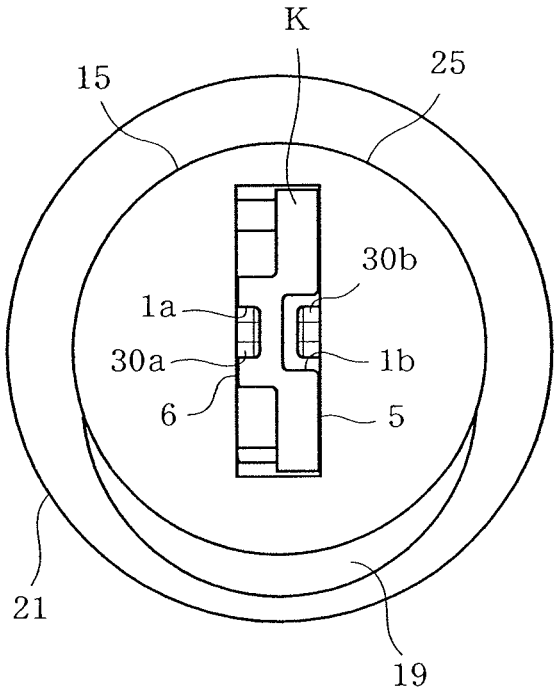
FIG. 4A is a longitudinal front section of the key inserted into a key insertion hole in a first orientation.
Figure 4B:
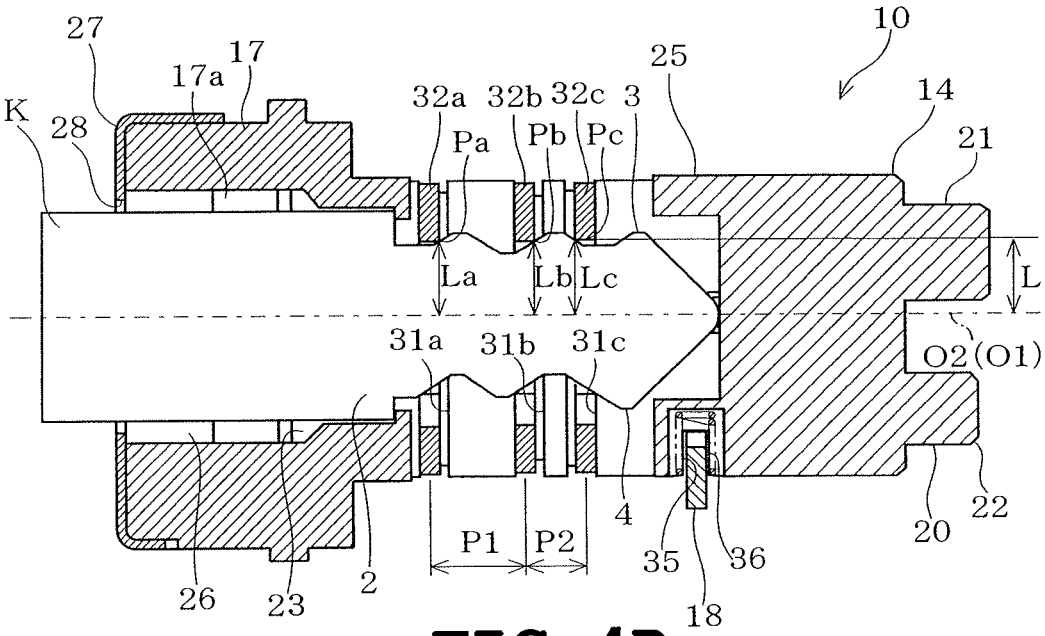
FIG. 4B is a longitudinal side section of the key inserted into the key insertion hole in the first orientation.

FIG. 4B shows the key K which is inserted into the key insertion hole 23 while assuming the aforementioned first orientation. As shown, reference symbol La designates a distance between a central axis O2 and an abutment portion Pa of the edge 3 against the tumbler 32*a*. Reference symbol Lb designates a distance between the central axis O2 and an abutment portion Pb of the edge 3 against the tumbler 32*b*. Reference symbol Lc designates a distance between the central axis O2 and an abutment portion Pc of the edge 3 against the tumbler 32*c*. The distances Pa, Pb and Pc are set so as to have the same length L (La=Lb=Lc=L). Each of the aforementioned distances Pa to Pc has a line segment extending in a direction perpendicular to the central axis O2 and corresponding to a widthwise direction of the key K (a radial direction of the key rotor 14). Accordingly, the edge 3 of the key K abuts against the tumblers 32*a* to 32*c* of the same shape thereby to move the tumblers to the respective tumbler disposition grooves 31*a* to 31*c*, whereby the key rotor 14 is allowed to be rotated.

Figure 5A:
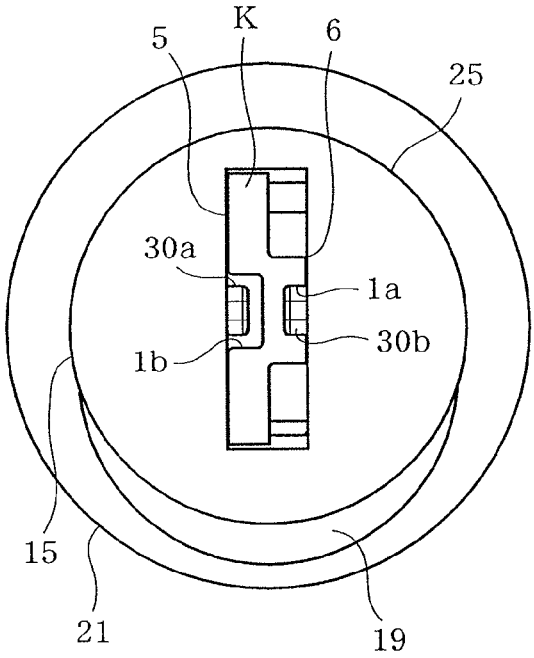
FIG. 5A is a view similar to FIG. 4A, showing the key inserted into the key insertion hole in a second orientation.
Figure 5B:
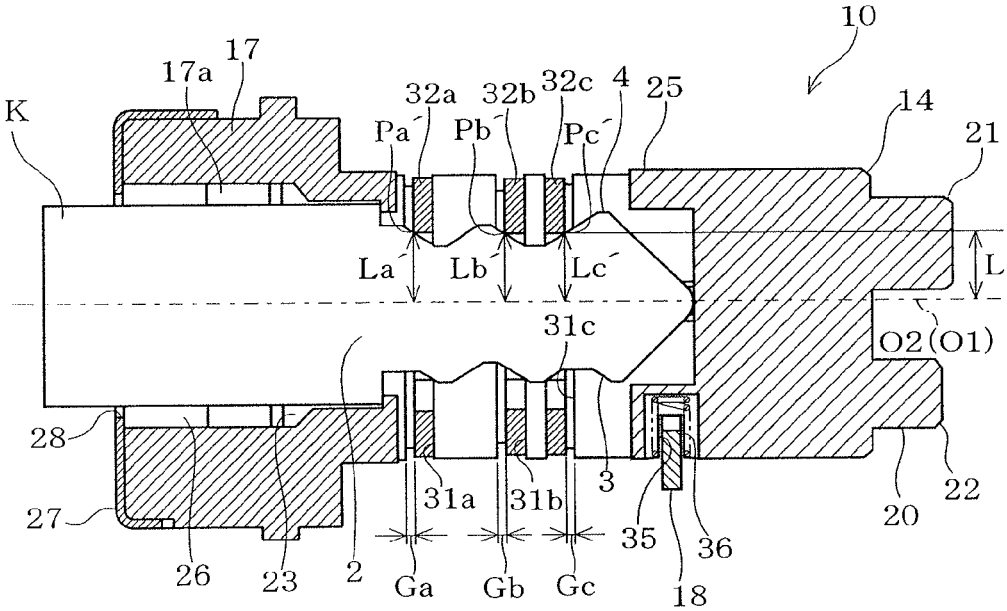
FIG. 5B is a view similar to FIG. 4B, showing the key inserted into the key insertion hole in the second orientation.

On the other hand, FIG. 5B shows the key K which is inserted into the key insertion hole 23 while assuming the second orientation. As shown, reference symbol La' designates a distance between the central axis O2 and an abutment portion Pa' of the edge 4 against the tumbler 32*a*. Reference symbol Lb' designates a distance between the central axis O2 and an abutment portion Pb' of the edge 4 against the tumbler 32*b*. Reference symbol Lc' designates a distance between the central axis O2 and an abutment portion Pc' of the edge 4 against the tumbler 32*c*. The distances Pa', Pb' and Pc' are also set so as to have the same length L' (La'=Lb'=Lc'=L) in the same manner as described above. Accordingly, the edge 4 of the key K abuts against the tumblers 32*a* to 32*c* thereby to move the tumblers to the respective tumbler disposition grooves 31*a* to 31*c* in the same manner as described above.

More specifically, the tumbler disposition grooves 31*a* to 31*c* are located axially with respect to the key rotor 14 so that the distances L between the central axis O2 and the abutment portions Pa to Pc equal one another and so that the distances L between the central axis O2 and the abutment portions Pa' to Pc' equal one another. To be more exact, the tumbler disposition grooves 31*a* to 31*c* have gaps Ga to Gc serving as allowances for the tumblers 32*a* to 32*c*, respectively, as shown in FIG. 5B. Accordingly, the tumblers 32*a* to 32*c* are displaced by the gaps Ga to Gc in the tumbler disposition grooves 31*a* to 31*c* in the relationship to inclination at the abutment portions Pa to Pc and Pa' to Pc' of the edges 3 and 4, respectively. In view of the gaps for the tumblers 32*a* to 32*c*, the tumbler disposition grooves 31*a* to 31*c* are located so that the aforesaid distances have such a relationship that La=La', Lb=Lb' and Lc=Lc'.

Thus, pitches P1 and P2 (see FIG. 4B) between the axially adjacent tumbler disposition grooves 31*a* to 31*c* differ from each other according to the configurations or profiles of the edges 3 and 4. Even in the case where the key K assumes the first or second orientation when being inserted into the key insertion hole 23, the tumblers 32*a* to 32*c* are reliably moved into the tumbler disposition grooves 31*a* to 31*c* in the inserted state of the key K. Accordingly, although the key K employs different profiles of the edges 3 and 4 on both sides respectively, the tumblers abutting against the edge 3 with the key K assuming the first orientation are the same as the tumblers abutting against the edge 4 with the key K assuming the second orientation, both being constituted by the same tumblers 32*a* to 32*c*.

Furthermore, the key insertion hole 23 is formed so that the paired guides 30*a* and 30*b* thereof are located at the symmetric positions where the guides fit into the grooves 1*a* and 1*b* of both sides 5 and 6 of the key K in the aforesaid inserted state, respectively. As a result, the key K is allowed to be inserted into the key insertion hole 23 even when assuming the first or second orientation. More specifically, the key is restricted to the forward or first orientation in the conventional lock devices when inserted into the key insertion hole. However, the lock device 10 of the embodiment is configured so that the key K is allowed to be inserted even when assuming either forward or reverse orientation, and so that the key K is guided by the guide 30*a* or 30*b*.

An assembly sequence of the lock device 10 will subsequently be described with reference to FIGS. 1 and 2. Firstly, the tumblers 32*a* to 32*c* are disposed so as to be biased by the spring members 33*a* to 33*c* at the projected portions 38 of the tumblers 32*a* to 32*c* respectively. The stopper ring 18 is also disposed in the stopper disposition groove 35 together with the spring member 36. Furthermore, the shutter 26, the cap 27 and the like are assembled to the flange 17 of the key rotor 14. The tumblers 32*a* to 32*c* and the stopper ring 18 are thrust inward so as to become co-planar with the outer periphery of the key rotor 14. In the thrust state, the key rotor 14 is accommodated into the rotor case 11 from the front side, whereupon the stopper ring 18 comes out to the rear step 16 side to engage the step, and the tumblers 32*a* to 32*c* come out to the tumbler disposition groove 12 side (lower side as viewed in FIG. 2) to engage the groove. Since the lock device 10 thus assembled has the shutter 26 attached to the cap 27, it is hard for rainwater, dust and the like to invade the interior of the lock device 10.

The above-described assembly is carried out, for example, when the conventional lock device in the lock body is to be replaced by the new lock device 10. In this case, only the key rotor 14 side may be replaced with the conventional rotor case being used, or the entire rotor case 11 may be replaced by the new key rotor 14.

The working of the lock device 10 thus constructed will now be described. FIG. 2 shows a locked state of the lock device 10. In the locked state, nothing is inserted into the key insertion hole 23, and the key rotor 14 has been rotated thereby to assume the position (a lock position) where the tumblers 32*a* to 32*c* protrude from the respective tumbler disposition grooves 31*a* to 31*c* into, for example, the lower tumbler engagement groove 12.

When the key K is inserted into the key insertion hole 23 while assuming the first orientation, the key is guided by the guide 30*a* in the groove 1*a* thereby to be moved in the direction of the central axis O2. The tumblers 32*a* to 32*c* are moved by the edge 3 of the key K against the biasing force of the spring member thereby to be accommodated into the respective tumbler disposition grooves 31*a* to 31*c*, as shown in FIG. 4B. In this state, the key rotor 14 is allowed to be rotated together with the key K when the key K is turned. In this case, when the key K is turned clockwise to a START position (not shown) as viewed in front view, for example, engine start-up can be effected.

The key K is inserted into the key insertion hole 23 while assuming the second orientation although the shank 2 thereof has asymmetric edges 3 and 4. In this case, the key K is moved in the direction of the central axis O2 while being guided by the guide 30*b* located in the groove 1*a*. The tumblers 32*a* to 32*c* are moved by the edge 4 of the key K so as to be accommodated into the respective tumbler disposition grooves 31*a* to 31*c* against the biasing force of the spring member as shown in FIG. 5B. Accordingly, when the key K is turned to the START position in the same manner as in the case where the key K assumes the first orientation, whereby engine start-up or the like can be effected.

As described above, even when the key K of the lock device is inserted into the key insertion hole 23 while assuming either first or second orientation, the distances La to Lc and La' to Lc' between the central axis O2 and the abutment portions Pa to Pc and Pa' to Pc' of the edges 3 and 4 against the tumblers 32*a* to 32*c* are set to the same value L.

Accordingly, there is no restriction in the insertion orientation of the key K to be inserted into the key insertion hole 23. When the key K is inserted into the key insertion hole 23, the tumblers 32*a* to 32*c* can be moved into the respective tumbler disposition grooves 31*a* to 31*c* by the edges 3 and 4 thereof. As a result, application of the lock device 10 can overcome a problem that the key K is inserted while assuming an incorrect orientation, whereupon the key K and the key rotor 14 can reliably be prevented from deformation. Thus, since the lock device 10 is configured to be adaptable to the asymmetric key K, the hitherto used key K can be used as a reversible key without replacement. Accordingly, for example, even when the key K is used in common with lock devices for door panels, a fuel filler opening of the vehicle and the like, only the lock device (the lock device mounted in the lock body of the steering column) desired to be used in the reversible manner needs to be replaced, and thus, not all the lock devices of the vehicle need to be replaced. This can reduce replacement costs to minimum.

The key rotor 14 has a plurality of tumbler disposition grooves 31*a* to 31*c* formed so as to extend axially, and a plurality of tumblers 32*a* to 32*c* is provided so as to correspond to the tumbler disposition grooves 31*a* to 31*c* respectively. The tumblers 32*a* to 32*c* have the same dimensions and the same shape. According to the construction, the lock device can be configured more economically and more easily, and error or failure can be eliminated in the assembly of the tumblers 32*a* to 32*c* into the respective tumbler disposition grooves 31*a* to 31*c*, whereupon the workability can be improved.

The key rotor 14 has three or more tumbler disposition grooves 31*a* to 31*c* formed so as to extend axially, and three or more tumblers 32*a* to 32*c* are provided so as to correspond to the tumbler disposition grooves 31*a* to 31*c* respectively. The tumbler disposition grooves 31*a* to 31*c* are located axially with respect to the key rotor 14 so that the distances La to Lc between the central axis O2 and the abutment portions Pa to Pc equal one another and so that the distances La' to Lc' between the central axis O2 and the abutment portions Pa' to Pc' equal one another. Consequently, the pitches P1 and P2 between the axially adjacent tumbler disposition grooves 31*a* to 31*c* differ from each other.

According to the above-described settings, in the case where the pitches P1 and P2 differ from each other, the tumblers 32*a* to 32*c* can reliably be moved into the tumbler disposition grooves 31*a* to 31*c* respectively even when the key K assuming either normal or reverse orientation is inserted into the key insertion hole 23. Furthermore, since the key K is rendered usable in the reversible manner as described above, the key K assuming a wrong orientation is prevented from being inserted into the key insertion hole 23 and forcedly turned. Consequently, since the strength (rigidity) of the key rotor 14 need not be increased more than necessary, the pitch P2 can be rendered smaller with realization of reversible operation of the key, whereupon the freedom in the design of the lock device can be improved.

The paired guides 30*a* and 30*b* are formed so as to be fitted in the grooves 1*a* and 1*b* formed in both sides of the key K in the key insertion hole 23 with the key K being inserted into the hole, respectively. Furthermore, the guides 30*a* and 30*b* are formed on the inner peripheral wall of the key rotor 14 so as to be symmetric about the central axis O2. At least one of the guides 30*a* and 30*b* is fitted in the groove 1*a* or 1*b* thereby to guide the key K to be inserted into the key insertion hole 23. According to the above-described construction, the key K assuming either normal or reverse orientation is allowed to be inserted into the key insertion hole 23 even though the key K is formed into an asymmetric shape. The key K can also be guided reliably when inserted into the key insertion hole 23.

As described above, since the conventional asymmetric key has opposite edges with different notch profiles, the key needs to be inserted into the key insertion hole of the lock device while assuming a correct orientation. In view of this, a special key configuration can be considered. More specifically, although differing from the foregoing embodiment, a pair of asymmetric keys (not shown) having the same configuration are overlapped into a single key while one of the keys assumes a first orientation and the other assumes a second orientation. However, when this special key is to be introduced, a hitherto used key will not naturally be used. In this case, all the lock devices of the vehicle need to be replaced by those suitable for the new key. This results in a problem of increase in replacement costs. Furthermore, although special, the key presents the sides of the same configuration when assuming the aforesaid first and second orientations. Thus, the key is of the reversible type that the configurations of the edges and a positional relation between the edges are maintained. Accordingly, the key naturally has no restriction in the orientation it assumes when inserted into a key insertion hole. Different tumblers suitable for the respective edges abut against paired edges having different configurations.

On the other hand, the key K used in the foregoing embodiment is formed into the asymmetric shape, that is, the side views (see FIGS. 4B and 5B) of the key differ from each other when the key assumes the first and second orientations. Furthermore, when the above-described configuration is employed, tumblers abutting against one 3 of the opposite edges of the key K and against the other 4 can be composed of the same tumblers 32*a* to 32*c* although the edges 3 and 4 have different profiles. Accordingly, the key K can be used in the reversible manner without employment of a complicate key structure (namely, without replacement of the key K as described above). This can reduce the costs of the lock device as low as possible and can simplify the construction of the lock device together with the costs of the key and sharing of tumblers 32*a* to 32*c*.

The present invention should not be limited to the above-described embodiment but may be modified or expanded as follows. The lock device 10 of the invention can be applied to general lock devices with which keys with asymmetric edges are used.

The numbers of the tumbler disposition grooves and the tumblers may be four or more or three or less. Furthermore, when the lock device includes a plurality of tumbler disposition grooves and a plurality of tumblers, the tumblers may have different shapes. In this case, locations of the tumbler disposition grooves in the axial direction of the key rotor are set so that the distances between the central axis O2 and the abutment portions of one of the opposite edges against the tumblers become equal to the distances between the central axis O2 and the abutment portions of the other edge against the tumblers, according to the shapes of the tumblers in the respective tumbler disposition grooves. According to this setting manner, the pitch between axially adjacent tumbler disposition grooves can be set at any value, whereupon the key can be used in the reversible manner as in the foregoing embodiment.

The tumblers of the key rotor need not be limited to the above-described tumblers. Axially lined pin holes communicating with the key insertion hole may be formed and tumbler pins accommodated in the respective pin holes may be used, instead. More specifically, when the key assuming either normal or reverse orientation is inserted in use of the tumbler pins, the distances between the central axis O2 and the abutment portions of one edge against the tumblers become equal to the distances between the central axis O2 and the abutment portions of the other edge against the tumblers in the inserted state of the key into the key insertion hole, whereby the key can be used in the reversible manner. The biasing member may comprise any one of various types of springs other than the spring members 33*a* to 33*c*. The positions and shape of the guides may be changed according to the shapes of the grooves of the key.

The invention claimed is:

1. A lock kit including a plate-shaped key including first and second edges having respective asymmetric profiles, a key rotor serving as a lock device usable with the key, and a rotor case housing the key rotor so that the key rotor is rotatable, the key having a width between the first and second edges, the width of the key being non-constant, wherein the rotor case has a tumbler engagement groove at an inner peripheral side thereof;

wherein the key rotor includes:

an axially extending key insertion hole and a radially extending tumbler disposition groove;

a tumbler movably disposed in the tumbler disposition groove and biased toward a radially peripheral side with respect to the key rotor by a biasing member so that an outer periphery of the tumbler is moved from the tumbler disposition groove to the tumbler engagement groove side to engage the tumbler engagement groove, thereby blocking the key rotor from rotative movement, the lock device being configured to receive the key into the key insertion hole so that either edge abuts against the tumbler in an inserted state of the key to move the tumbler into the tumbler disposition groove, whereby the key rotor is allowed to be rotatively moved;

wherein the key rotor is configured to receive the asymmetric key in a first orientation with a first distance measured from a central axis of the inserted key to an abutment point of the first edge of the key and the tumbler, and further configured to receive the asymmetric key in a reversed second orientation with a second distance measured from the central axis of the inserted key to an abutment point of the second edge of the key and the tumbler, the second orientation being obtained by rotating the key in the first orientation 180° about the central axis;

wherein the first and second distances are measured in the same radial direction from the central axis of the key and are equal to each other, the tumbler is moved into the tumbler disposition groove by causing the first edge of the key to abut against the tumbler when the key in the first orientation is inserted into the key insertion hole, and the tumbler is moved into the tumbler disposition groove by causing the second edge of the key to abut against the tumbler when the key in the second orientation is inserted into the key insertion hole, whereby the key is operable to unlock the lock device in both the first and second orientations;

wherein the key rotor has not less than three axially adjacent tumbler disposition grooves;

wherein three or more tumblers are provided so as to correspond to the tumbler disposition grooves respectively;

wherein the tumblers have respective sizes equal to one another, and wherein the tumbler disposition grooves have respective positions set according to the profiles of the first and second edges of the key so that the first and second distances are equal to each other among the tumblers, whereby the axially adjacent tumbler disposition grooves have pitches differing from each other.

2. The lock kit according to claim 1, wherein the lock device is configured for use with the key having two sides formed with respective grooves extending along the central axis of the key;

the key insertion hole of the key rotor is provided with a pair of guides which are configured to fit into at least one of the grooves of the inserted key to thereby guide the key inserted into the key insertion hole; and the guides are configured to fit inside the grooves of both sides of the inserted key in an interior of the key insertion hole when the key has been inserted into the key insertion hole and the guides are formed at symmetric positions with respect to the central axis of the inserted key.

3. The lock kit according to claim 1, wherein at least one tumbler disposition groove comprises a gap spacing sufficient to allow displacement of the corresponding tumbler in directions along a central axis of the key rotor.

4. The lock kit according to claim 3, wherein the gap spacing of the at least one tumbler disposition groove defines an allowance for the corresponding tumbler to align with edges of different inclinations on opposite edges of the asymmetric key.

5. The lock kit according to claim 1, wherein the tumbler disposition grooves comprise gap spacings sufficient to allow displacement of the tumblers in directions along a central axis of the key rotor.

6. The lock kit according to claim 5, wherein the gap spacings of the tumbler disposition grooves define allowances for the tumblers to align with edges of different inclinations on opposite edges of the asymmetric key.

7. A key rotor serving as a lock device usable with a plate-shaped key including first and second edges having respective asymmetric profiles, the key rotor being configured to be rotatably housed in a rotor case, the key having a width between the first and second edges, the width of the key being non-constant, wherein the rotor case has a tumbler engagement groove at an inner peripheral side thereof;

wherein the key rotor includes:

an axially extending key insertion hole and a radially extending tumbler disposition groove;

a tumbler movably disposed in the tumbler disposition groove and biased toward a radially peripheral side with respect to the key rotor by a biasing member so that an outer periphery of the tumbler is moved from the tumbler disposition groove to the tumbler engagement groove side to engage the tumbler engagement groove, thereby blocking the key rotor from rotative movement, the lock device being configured to receive the key into the key insertion hole so that either edge abuts against the tumbler in an inserted state of the key to move the tumbler into the tumbler disposition groove, whereby the key rotor is allowed to be rotatively moved;

wherein the key rotor is configured to receive the asymmetric key in a first orientation with a first distance measured from a central axis of the inserted key to an abutment point of the first edge of the key and the tumbler, and further configured to receive the asymmetric key in a reversed second orientation with a second distance measured from the central axis of the inserted key to an abutment point of the second edge of the key and the tumbler, the second orientation being obtained by rotating the key in the first orientation 180° about the central axis;

wherein the first and second distances are measured in the same radial direction from the central axis of the key and are equal to each other, the tumbler is moved into the tumbler disposition groove by causing the first edge of the key to abut against the tumbler when the key in the first orientation is inserted into the key insertion hole, and the tumbler is moved into the tumbler disposition groove by causing the second edge of the key to abut against the tumbler when the key in the second orientation is inserted into the key insertion hole, whereby the key is operable to unlock the lock device in both the first and second orientations;

wherein the key rotor has not less than three axially adjacent tumbler disposition grooves;

wherein three or more tumblers are provided so as to correspond to the tumbler disposition grooves respectively;

wherein the tumblers have respective sizes equal to one another; and wherein the tumbler disposition grooves have respective positions set according to the profiles of the first and second edges of the key so that the first and second distances are equal to each other among the tumblers, whereby the axially adjacent tumbler disposition grooves have pitches differing from each other.

8. A lock kit including a plate-shaped key including first and second edges having respective asymmetric profiles, a key rotor serving as a lock device usable with the key, and a rotor case housing the key rotor so that the key rotor is rotatable, wherein the rotor case has a tumbler engagement groove at an inner peripheral side thereof;

wherein the key rotor includes:

an axially extending key insertion hole and a radially extending tumbler disposition groove;

a tumbler movably disposed in the tumbler disposition groove and biased toward a radially peripheral side with respect to the key rotor by a biasing member so that an outer periphery of the tumbler is moved from the tumbler disposition groove to the tumbler engagement groove side to engage the tumbler engagement groove, thereby blocking the key rotor from rotative movement, the lock device being configured to receive the key into the key insertion hole so that either the first or the second edge abuts against the tumbler in an inserted state of the key to move the tumbler into the tumbler disposition groove, whereby the key rotor is allowed to be rotatively moved;

wherein the key rotor is configured to receive the asymmetric key in a first orientation with a first distance measured from a central axis of the inserted key to an abutment point of the first edge of the key and the tumbler, and further configured to receive the asymmetric key in a reversed second orientation with a second distance measured from the central axis of the inserted key to an abutment point of the second edge of the key and the tumbler, the second orientation being obtained by rotating the key in the first orientation 180° about the central axis;

wherein the first and second distances are measured in the same radial direction from the central axis of the key and are equal to each other, the tumbler is moved into the tumbler disposition groove by causing the first edge of the key to abut against the tumbler when the key in the first orientation is inserted into the key insertion hole, and the tumbler is moved into the tumbler disposition groove by causing the second edge of the key to abut against the tumbler when the key in the second orientation is inserted into the key insertion hole, whereby the key is operable to unlock the lock device in both the first and second orientations.

9. A key rotor usable with a plate-shaped key including first and second edges having respective asymmetric profiles, the key rotor being configured to be rotatably housed in a rotor case, the key having a width between the first and second edges, the width of the key being non-constant, wherein the key rotor includes:

a rotor body with an axially extending key insertion hole and a radially extending tumbler disposition groove;

a tumbler movably disposed in the tumbler disposition groove and biased toward a radially peripheral side with respect to the key rotor by a biasing member so that an outer periphery of the tumbler is moved from the tumbler disposition groove so as to protrude from the rotor body, the key rotor being configured to receive the key into the key insertion hole so that either edge abuts against the tumbler in an inserted state of the key to move the tumbler into the tumbler disposition groove, whereby the tumbler is retracted within the rotor body when moved into the tumbler disposition groove;

wherein the key rotor is configured to receive the asymmetric key in a first orientation with a first distance measured from a central axis of the inserted key to an abutment point of the first edge of the key and the tumbler, and further configured to receive the asymmetric key in a reversed second orientation with a second distance measured from the central axis of the inserted key to an abutment point of the second edge of the key and the tumbler, the second orientation being obtained by rotating the key in the first orientation 180° about the central axis;

wherein the first and second distances are measured in the same radial direction from the central axis of the key and are equal to each other, the tumbler is moved into the tumbler disposition groove by causing the first edge of the key to abut against the tumbler when the key in the first orientation is inserted into the key insertion hole, and the tumbler is moved into the tumbler disposition groove by causing the second edge of the key to abut against the tumbler when the key in the second orientation is inserted into the key insertion hole, whereby the key is operable to retract the tumbler into the rotor body in both the first and second orientations;

wherein the key rotor has not less than three axially adjacent tumbler disposition grooves;

wherein three or more tumblers are provided so as to correspond to the tumbler disposition grooves respectively;

wherein the tumblers have respective sizes equal to one another; and wherein the tumbler disposition grooves have respective positions set according to the profiles of the first and second edges of the key so that the first and second distances are equal to each other among the tumblers, whereby the axially adjacent tumbler disposition grooves have pitches differing from each other.

* * * * *